US007435172B2

(12) United States Patent
Hall

(10) Patent No.: US 7,435,172 B2
(45) Date of Patent: Oct. 14, 2008

(54) BLACKJACK PUSH

(76) Inventor: Geoffrey William Hall, 323 Haslucks Green Road, Shirley, Solihull B90 2NF (GB)

( * ) Notice: Subject to any disclaimer, the term of this patent is extended or adjusted under 35 U.S.C. 154(b) by 614 days.

(21) Appl. No.: 10/963,899

(22) Filed: Oct. 13, 2004

(65) Prior Publication Data

US 2005/0049025 A1 Mar. 3, 2005

Related U.S. Application Data

(63) Continuation-in-part of application No. 10/654,876, filed on Sep. 4, 2003, now abandoned.

(30) Foreign Application Priority Data

Sep. 4, 2002 (GB) ..... 00220501.1

(51) Int. Cl.
*A63F 9/20* (2006.01)

(52) U.S. Cl. ..... 463/12; 273/292

(58) Field of Classification Search ..... 463/12; 273/292

See application file for complete search history.

(56) References Cited

U.S. PATENT DOCUMENTS

| | | | | |
|---|---|---|---|---|
| 1,926,429 | A | 9/1933 | Bendelari | |
| 4,041,880 | A | 8/1977 | Schankman | |
| 4,441,714 | A | 4/1984 | Goott, Jr. | |
| 4,552,362 | A | 11/1985 | Oake | |
| 4,648,602 | A | 3/1987 | Maroney | |
| 4,651,997 | A | 3/1987 | Wood | |
| 4,659,087 | A | 4/1987 | Shen et al. | |
| 4,760,527 | A | 7/1988 | Sidley | |
| 4,836,553 | A | 6/1989 | Suttle et al. | |
| 4,861,041 | A | 8/1989 | Jones et al. | |
| 4,948,134 | A | 8/1990 | Suttle et al. | |
| D311,474 | S | 10/1990 | Hoffman | |
| 5,022,653 | A | 6/1991 | Suttle et al. | |
| 5,060,712 | A | 10/1991 | Ehrlich | |
| 5,078,405 | A | 1/1992 | Jones et al. | |
| 5,084,321 | A | 1/1992 | Sui | |
| 5,098,107 | A | 3/1992 | Boylan et al. | |
| 5,174,579 | A * | 12/1992 | Griffiths | 273/292 |
| 5,224,708 | A | 7/1993 | Gathman et al. | |
| 5,265,877 | A | 11/1993 | Boylan et al. | |
| 5,275,411 | A | 1/1994 | Breeding | |
| 5,275,415 | A | 1/1994 | Wisted | |
| 5,280,915 | A | 1/1994 | Groussman | |
| 5,320,356 | A | 6/1994 | Cauda | |

(Continued)

FOREIGN PATENT DOCUMENTS

WO WO 03/061789 A1 7/2003

OTHER PUBLICATIONS

Paul-Son Gaming Supplies, Oct. 1987, pp. 19-28.

(Continued)

*Primary Examiner*—John M Hotaling, II
*Assistant Examiner*—Jeffrey K Wong
(74) *Attorney, Agent, or Firm*—Muskin & Cusick LLC

(57) ABSTRACT

A modification to the card game blackjack in which bets are pushed, if the total of the cards in the player's and the dealer's hands are of equal value and add up to 21 or less, or if the total of the cards in the dealer's hand equals a predetermined value between 22 and 26 and the total of the cards in the player's hand is 21 or less.

17 Claims, 1 Drawing Sheet

U.S. PATENT DOCUMENTS 5,322,295 A * 6/1994 Cabot et al. ..... 273/292
5,328,189 A 7/1994 Malek
5,368,305 A 11/1994 Rodda et al.
5,374,067 A 12/1994 Jones
5,377,973 A 1/1995 Jones et al.
5,380,012 A 1/1995 Jones et al.
5,382,025 A 1/1995 Sklansky et al.
5,403,015 A 4/1995 Forte et al.
5,407,209 A 4/1995 Prerost
5,431,407 A 7/1995 Hofberg et al.
5,437,462 A 8/1995 Breeding
5,489,101 A 2/1996 Moody
5,529,309 A 6/1996 Bartlett
5,531,448 A 7/1996 Moody
5,538,252 A * 7/1996 Green ..... 273/306
5,540,444 A 7/1996 Nguyen
5,544,892 A 8/1996 Breeding
5,568,666 A 10/1996 Seibert
5,577,731 A 11/1996 Jones
5,607,162 A 3/1997 Boylan et al.
5,632,487 A 5/1997 Nguyen
5,636,842 A 6/1997 Cabot et al.
5,645,281 A 7/1997 Hesse et al.
5,649,705 A 7/1997 String
5,653,444 A 8/1997 Dahl
5,660,390 A 8/1997 Ginzburg et al.
5,664,781 A 9/1997 Feola
5,707,286 A 1/1998 Carlson
5,707,287 A 1/1998 Mc Crea, Jr.
5,711,525 A 1/1998 Breeding
5,718,430 A 2/1998 Aramapakul et al.
5,720,484 A 2/1998 Hsu
5,725,216 A 3/1998 Jones
5,732,949 A 3/1998 Josephs
5,732,950 A 3/1998 Moody
5,735,524 A 4/1998 Wisted
5,743,530 A 4/1998 Sklad et al.
5,752,702 A 5/1998 Mc Doniel
5,762,340 A 6/1998 Feola
5,772,211 A 6/1998 Nazaryan et al.
5,775,696 A 7/1998 Sidlow
5,799,946 A 9/1998 Groussman
5,803,460 A * 9/1998 Hesse ..... 273/292
5,810,360 A 9/1998 Srichayaporn
5,813,673 A 9/1998 Richardson
5,820,128 A 10/1998 Brunelle
5,823,873 A 10/1998 Moody
5,829,750 A 11/1998 Long
5,836,586 A * 11/1998 Marks et al. ..... 273/292
5,845,907 A 12/1998 Wells
5,851,011 A 12/1998 Lott
5,865,437 A 2/1999 Moore, Jr.
5,882,009 A 3/1999 Schaefer
5,882,260 A 3/1999 Marks et al.
5,895,047 A 4/1999 Callahan
5,911,626 A 6/1999 Mc Crea, Jr.
5,918,884 A 7/1999 Di Muro
5,944,314 A 8/1999 Stavinsky
5,975,529 A 11/1999 de Keller
5,997,002 A 12/1999 Goldman
6,000,699 A 12/1999 Long
6,007,066 A 12/1999 Moody
6,062,563 A 5/2000 de Keller
6,065,752 A 5/2000 Beltran
6,070,873 A 6/2000 Perkins
D427,644 S 7/2000 Stern
6,098,984 A 8/2000 Moore, Jr.
6,102,402 A 8/2000 Scott et al.
6,117,012 A 9/2000 Mc Crea, Jr.
6,120,030 A 9/2000 Chou
6,131,908 A 10/2000 Palmer
6,165,069 A 12/2000 Sines et al.
6,170,828 B1 1/2001 Mostashari
6,182,969 B1 2/2001 Green
6,196,548 B1 3/2001 Schaefer
6,203,018 B1 3/2001 Osuch
6,206,373 B1 3/2001 Garrod
6,220,597 B1 4/2001 Scibetta
6,220,598 B1 4/2001 Kweitko et al.
6,220,960 B1 4/2001 Kryzhanovsky
6,227,969 B1 5/2001 Yoseloff
6,234,485 B1 5/2001 Perkins
6,270,079 B1 8/2001 Chamberlain
6,270,404 B2 8/2001 Sines et al.
6,273,423 B1 8/2001 Promutico
6,279,910 B1 8/2001 dekeller
6,296,251 B1 * 10/2001 Webb ..... 273/292
6,336,859 B2 1/2002 Jones et al.
6,406,020 B1 6/2002 Reed
6,406,024 B1 6/2002 Perkins
6,428,002 B1 8/2002 Baranauskas
6,428,005 B2 8/2002 Au-Yeung
6,435,507 B1 8/2002 Trucksess
6,454,266 B1 9/2002 Breeding et al.
6,471,210 B1 10/2002 Goldman et al.
6,481,719 B2 11/2002 Webb
6,508,707 B2 1/2003 De Mar
6,511,068 B1 1/2003 Sklansky et al.
6,517,072 B1 2/2003 Mc Inerney
6,523,831 B2 2/2003 Webb
6,543,773 B2 4/2003 Mims
6,575,464 B1 6/2003 Fertitta et al.
6,626,433 B2 9/2003 Scibetta
6,637,747 B1 10/2003 Garrod
6,688,599 B1 2/2004 Manalili
6,703,329 B2 3/2004 Principe
6,723,668 B2 4/2004 Principe
6,773,013 B2 * 8/2004 Caldwell ..... 273/292
6,796,898 B1 9/2004 Timpano
2001/0000118 A1 4/2001 Sines
2001/0040345 A1 11/2001 Au-Yeung
2002/0008356 A1 1/2002 de Keller
2002/0033577 A1 3/2002 Mims
2002/0036381 A1 3/2002 Scibetta
2002/0070500 A1 6/2002 Au-Yeung
2002/0074724 A1 6/2002 Webb
2002/0084587 A1 7/2002 Bennett et al.
2002/0123279 A1 9/2002 Principe
2002/0171201 A1 11/2002 Au-Yeung
2003/0030217 A1 2/2003 Webb
2003/0042679 A1 3/2003 Snow
2003/0090063 A1 5/2003 Jarvis et al.
2003/0107176 A1 6/2003 Goldman et al.
2003/0151201 A1 8/2003 Lee
2003/0173740 A1 9/2003 Weldon
2003/0178776 A1 9/2003 Hall
2003/0218303 A1 11/2003 Walker et al.
2004/0036219 A1 2/2004 Schibetta
2004/0080110 A1 4/2004 Webb
2004/0116172 A1 6/2004 Hall
2004/0157656 A1 * 8/2004 Jackson ..... 463/12
2004/0227294 A1 11/2004 Au-Yeung

OTHER PUBLICATIONS

Derwent—2004-169249 Gaming Cloth for Covering Playing Surface of Gaming Table in Casino-1999-J.A. Brasier & S.J.
Geoff Hall (author), http://web.archive.org/web/20030802150836/http://www.blackjackswitch.com/rules.html Aug. 2, 2003.
Geoff Hall (author), http://web.archive.org/web/20020603133956/http://blackjackswitch.com/rules.htm Jun. 3, 2002.
Ian Sutton, "Blackjack Switch makes an impressive debut at the WGCE," http://www.gamingfloor.com/features/bjswitch.htm, Dec. 4, 2000.

* cited by examiner

BLACKJACK PUSH

This application is a continuation-in-part of U.S. application Ser. No. 10/654,876 filed on Sep. 4, 2003 now abandoned, which in turn claims priority from British application serial number 00220501.1 filed on Sep. 4, 2002.

FIELD OF THE INVENTION

This invention relates to casino house games or, more specifically, the invention relates to the casino game of Blackjack.

BACKGROUND OF THE INVENTION

Blackjack is a popular casino game and various steps have been taken to try and keep the game interesting and stimulating for the players. This invention is a modification of Blackjack which allows the casino to enjoy an additional edge in the game, by allowing the dealer to "push" i.e. not pay players when the dealer has reached a designated total higher than 21. The game is played with any number of deck of cards.

SUMMARY OF THE INVENTION

Normally, in the game of regular Blackjack, any total of 22-26 is considered a "bust" hand so, by choosing 1 or more of these totals to now be a "push", will create an extra edge for the casino.

To compensate for this extra edge given to the casino, other player-beneficial rules can be added within the game, to allow the casino edge to reduce overall to a similar edge found in regular Blackjack. Examples such as paying higher than normal odds for "Blackjacks", allowing players to place additional bets after seeing their initial cards and allowing more favorable "doubling" and "splitting" opportunities are a few of the player benefits that could be included.

Additionally, players will be allowed to wager on whether the dealer will arrive at the specified "push" total, or totals. A specially designed layout will include betting areas that allow players the option of placing a further bet (FIG. 1) and the player will win the get if a wager has been placed in the specified betting area and the dealer has made the designated total.

Ideally, the dealer will just "push" on one designated total between 22-26 and the name of the game can reflect which total has been included in the rules. For example, a game called "Blackjack Push 26" will inform the players that the dealer will "push" players' bets on a total of 26. Obviously, the specially designed layout will include betting areas that allow the player to wager on the outcome of the dealer making a total of 26.

DETAILED DESCRIPTION OF THE INVENTION

Figure 1:
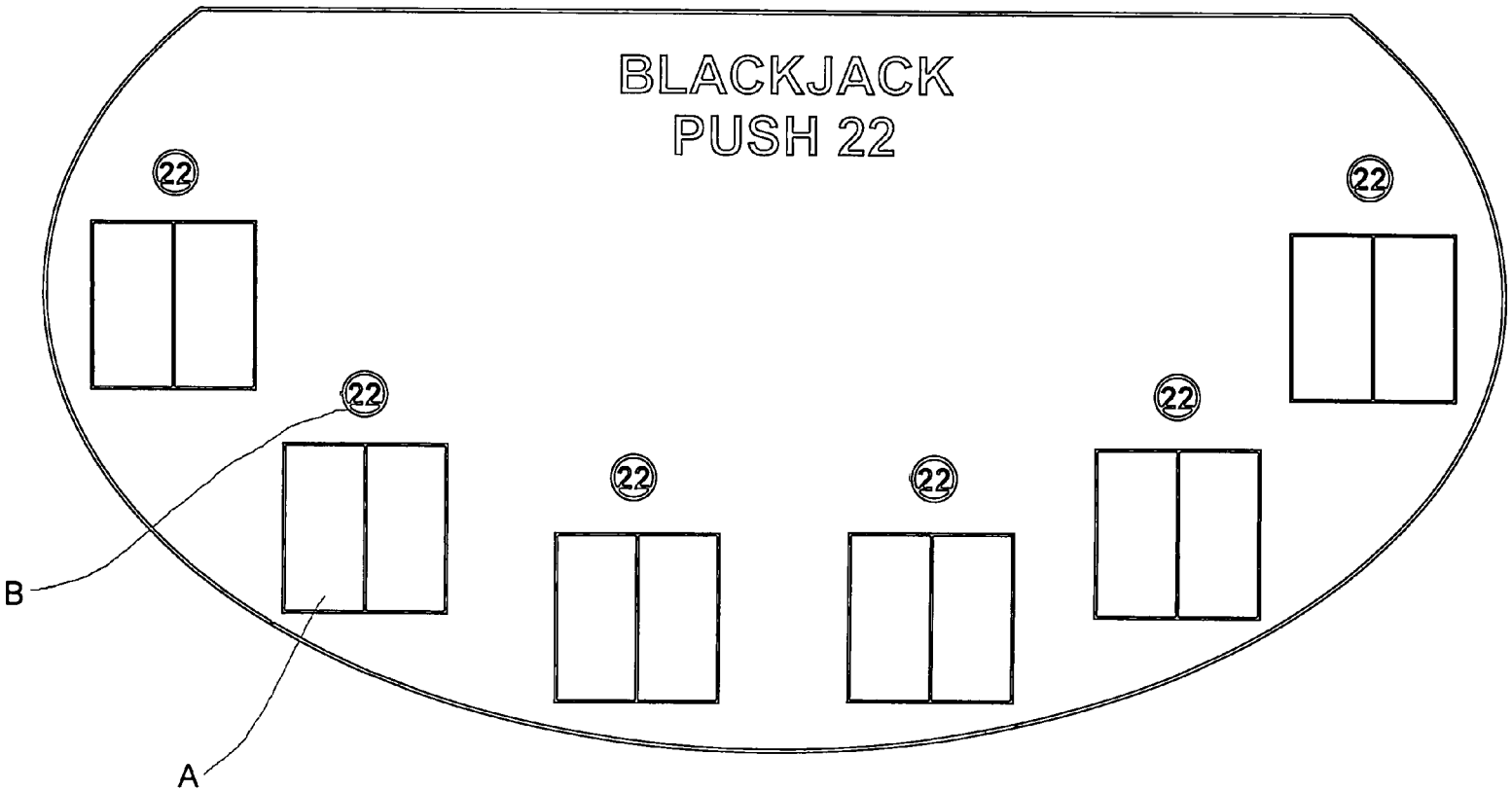
FIG. 1 is a pictural diagram of a preferred embodiment of the invention.

A specially designed layout is used with additional betting areas having "22" marked on them (see item "B" in diagram), as this particular embodiment allows the dealer to "push" on a total of 22. Each "Blackjack" betting area is divided in half (see item "A" in the diagram) to allow players to place 2 identical "Blackjack" wagers. As the dealer is allowed to "push" on a total of 22, then the players advantageous rule is that after receiving their first 4 cards, that make up the start of each of their 2 Blackjack hands, they can then decide in which order the second cards are placed. In other words, once the players have received their 2 Blackjack hands they then have the option to switch over their 2 top cards (i.e. the second cards from each Blackjack hand). For example, the player is dealt a six and an Ace as his first cards, which make up the initial part of each of his Blackjack hands. Then the player receives a "Jack", on top of the 6 to make "16" and a "4", on top of the Ace' to make "soft" 15. As the Jack and four are the second cards dealt out, then the player may switch these 2 cards over, or, put simply, interchange them. The player will now have one hand consisting of a six and a four and the other hand consisting of and Ace and a Jack.

Once the player has decided whether to "switch", or not, then both of the player's hands are played out as in regular Blackjack.

Additionally, the player can place a wager in the "22" betting area, before any cards are dealt out. This wager is left until it is the dealer's turn to play his hand. If the dealer makes any total other than 22, then he takes the player's "22" wager. However, if the dealer makes a total of 22 then he will pay the player a predetermined odds, for example 10/1.

The preferably number of player betting boxes, for this particular embodiment, would be 5 although this could be increased or decreased if the casino so desires.

As well as this specific embodiment, the invention could contain one or more of the following:

(i) In the second embodiment, "Blackjacks" would still be paid even if the dealer had reached the designated "push" total.

(ii) In the third embodiment, higher odds could be awarded to the player placing a "push total" bet if the dealer's "push total" was made up of a specific holding. For example, in "Push 22", the player could be paid much higher odds, for example 25/1, if the dealer were to obtain a total of 22 with four cards of rank, for example 4, 5, 6 & 7, in any order. Again, even higher odds, for example 100/1, could be paid if the 22 was obtained by the four cards of rank specified above were dealt in order or if the four cards of rank specified above were of the same suit.

(iii) In the fourth embodiment, the "push" feature can be included in games of Blackjack where the player is only required to play one hand.

(iv) In the fifth embodiment, the player would be allowed to increase the initial wager, if desired, after seeing either one, or more, of his own cards and also, as extra option, after seeing the dealer's upcard. Any mixture of this could be advocated depending on the casino's edge requirements.

(v) Suited "Blackjacks" could be paid at higher odds than the usual 3/2 payout.

(vi) "Blackjacks" could be paid at even money.

(vii) If players hand comprised three of four cards constituting a specified three/four card poker hand, for example three/four of a kind; a straight; a flush; or a straight flush, the hand would be an automatic winner, irrespective of the total, provided that the total is below 22. Bonus odds may be paid out, depending on the rank of the poker hand, for example 3/1 for three of a kind or a straight flush.

(viii) If a player is dealt a designated wild card, for example card of designated rank e.g. 10, or reaches a designated value, then the bet will be pushed, if the players total subsequently exceeds 21.

This invention could also be used on the Internet, installed on video machines or stored on a disc and played on a computer.

The invention claimed is:

1. A method to play a wagering card game based on blackjack, the method comprising:

one or more players place a bet;

a dealer deals at least one card to himself and at least one pair of cards to each of said one or more players;

the dealer then deals one or more further optional cards to each player, until the player stands or the total of the value of the cards in the player's hand exceeds 21;

if the total of the value of cards in the player's hand exceeds 21, the player loses the bet;

the dealer then deals one or more further cards to himself, until he stands, or the total of the value of the cards in his hand exceeds 21;

if the total of the value of the cards in the dealer's hand is 21 or less and is greater than the value of the cards in the player's hand, then the player loses the bet;

if the total of the value of the cards in the player's hand is 21 or less and is greater than the total of the value of the cards in the dealer's hand, then the dealer loses the bet;

if the player's and dealer's hand are of equal value and 21 or less, then the bet is pushed; or if the total of the value of the cards of the dealer's hand is a single numerical point total selected from 22 to 26, then the dealer would push the bet instead of paying the bet as a winning wager if the total of the value of the cards of the dealer's hand is higher than 21 but not the single numerical point total.

2. The card game according to claim 1 in which the dealer deals two or more pairs of cards to each player, each pair of cards constituting a separate hand to be played in accordance with claim 1.

3. The card game according to clam 1 in which the dealer initially deals two pairs of cards to each player, the player having the option to switch cards between the two pairs of cards, each pair of cards being subsequently played as a separate hand in the manner claimed in claim 1.

4. The card game according to claim 1 in which the dealer must stand when the total of the value of the cards in his hand is 17 or more.

5. The card game according to claim 1 in which the dealer pays out on blackjacks, even if the total of the value of the cards in the dealer's hand equals the single numerical point total between 22 and 26.

6. The card game according to claim 1 in which each player may place an optional bet that the total of the value of the cards in the dealer's hand will equal the single numerical point total between 22 and 26.

7. The card game according to claim 6 in which odds paid out on the optional bet may be increased, if the dealer's hand meets specified criteria.

8. The card game according to claim 7 in which the odds paid out on the optional bet are increased when the cards in the dealer's hand are each of specified value and/or the cards in the dealer's hand are suited.

9. The card game according to claim 1 in which a player may increase his initial bet after seeing one or more of the cards dealt to him.

10. The card game according to claim 1 in which blackjacks are paid out at even money.

11. The card game according to claim 10 in which suited blackjacks are paid out at increased odds.

12. The cardgame according to clam 1 in which the dealer pays out if the players hand is of specified rank, irrespective of the total, provided that the total is less than 22.

13. The card game according to claim 12 in which the dealer pays out if the players hand constitutes a specified three or four card poker hand.

14. The card game according to claim 13 in which the dealer pays out if the players hand is selected from the group containing, three of a kind; four of a kind; a straight; a flush and a straight flush.

15. The card game according to claim 12 in which the odds paid depend on a rank of the players specified hand.

16. The card game according to claim 1 in which if the players hand includes a specified wild card, the bet is pushed if the total of the player hand exceeds 21.

17. The card game according to claim 1 in which if the players hand totals a specified value, then the bet is pushed if the total of the players cards on taking one or more additional cards, then exceeds 21.

* * * * *